United States Patent [19]

Cook et al.

[11] Patent Number: 4,748,959

[45] Date of Patent: Jun. 7, 1988

[54] REGULATION OF ENGINE PARAMETERS IN RESPONSE TO VAPOR RECOVERY PURGE SYSTEMS

[75] Inventors: Jeffrey A. Cook, Dearborn; Douglas R. Hamburg, Birmingham, both of Mich.

[73] Assignee: Ford Motor Company, Dearborn, Mich.

[21] Appl. No.: 45,510

[22] Filed: May 4, 1987

[51] Int. Cl.[4] ..... F02M 25/08; F02M 51/00

[52] U.S. Cl. ..... 123/520; 123/489; 123/416

[58] Field of Search ..... 123/406, 415, 416, 417, 123/440, 489, 518, 519, 520

[56] References Cited

U.S. PATENT DOCUMENTS

| | | | |
|---|---|---|---|
| 3,680,318 | 8/1972 | Nakajima et al. | 123/519 X |
| 3,872,848 | 3/1975 | King | 123/520 |
| 4,013,054 | 3/1977 | Balsley et al. | 123/519 |
| 4,031,869 | 6/1977 | Onishi et al. | 123/408 |
| 4,116,184 | 9/1978 | Tomita | 123/519 X |
| 4,275,697 | 6/1981 | Stoltman | 123/520 |
| 4,308,842 | 1/1982 | Watanabe et al. | 123/520 |
| 4,326,489 | 4/1982 | Heitert | 123/520 |
| 4,377,142 | 3/1983 | Otsuka et al. | 123/440 |
| 4,411,241 | 10/1983 | Ishida | 123/568 |
| 4,467,769 | 8/1984 | Matsumura | 123/520 |
| 4,527,532 | 7/1985 | Kasai et al. | 123/520 |
| 4,630,581 | 12/1986 | Shibata | 123/325 |
| 4,641,623 | 2/1987 | Hamburg | 123/518 |
| 4,646,702 | 3/1987 | Matsubara et al. | 123/520 |
| 4,677,956 | 7/1987 | Hamburg | 123/520 |

FOREIGN PATENT DOCUMENTS

| | | |
|---|---|---|
| 0086555 | 5/1982 | Japan . |
| 0131343 | 5/1983 | Japan . |

OTHER PUBLICATIONS

SAE 82066, "Measurement and Improvement of the Transient A/F Characteristics of an Electronic Fuel Injection System", Hamburg et al., (1-1982).

*Primary Examiner*—Willis R. Wolfe

*Attorney, Agent, or Firm*—Allan J. Lippa; Peter Abolins

[57] ABSTRACT

An apparatus and a method for controlling hydrocarbon emission from an internal combustion engine having an air/fuel intake coupled to a fuel vapor recovery system. Fuel vapors are periodically purged from the fuel vapor recovery system into the air/fuel intake. The mixture of air fuel vapor and fuel inducted into the air/fuel intake is regulated by a feedback loop responsive to an exhaust gas oxygen sensor to maintain a desired air/fuel ratio. An indication of the fuel vapor concentration in the fuel vapor recovery system is provided to control various engine parameters and thereby reduce hydrocarbon emissions during the response time of the feedback loop. In one aspect of the invention, the flow rate of the purged fuel vapors is controlled to be in inverse relation to the concentration of purged fuel vapors during the response time of the feedback loop. In another aspect of the invention, the engine timing is retarded in relation to the concentration of purged fuel vapors during the response time of the feedback loop.

12 Claims, 3 Drawing Sheets

REGULATION OF ENGINE PARAMETERS IN RESPONSE TO VAPOR RECOVERY PURGE SYSTEMS

BACKGROUND OF THE INVENTION

The field of the invention relates to controlling the level of hydrocarbon emissions from an internal combustion engine. More specifically, the invention relates to controlling hydrocarbon emissions which may result by purging the fuel vapors from a fuel vapor recovery system into the internal combustion engine.

Motor vehicles of recent years are required to have a fuel vapor recovery system to reduce the amount of fuel vapors released into the atmosphere. Typically, a canister containing a fuel vapor absorbing material, such as activated charcoal, is coupled between the fuel system and the air/fuel intake of the engine. A purge valve positioned between the canister and air/fuel intake enables the periodic purging of fuel vapors from the canister dependent upon engine operating parameters. Systems of this type are disclosed in U.S. Pat. Nos. 4,308,842 issued to Watanabe et al, 4,326,489 issued to Heitert, 4,377,142 issued to Otsuka et al, and 4,411,241 issued to Ishida.

A problem with these recovery systems is that the purged fuel vapors inducted into the engine may alter the air/fuel ratio thereby increasing hydrocarbon emissions. An approach directed to this problem is diclosed in both U.S. Pat. No. 4,013,054 issued to Balsley et al and Japanese Pat. No. 57-86555 by Yanagisowa, wherein the purge flow rate is regulated in response to a feedback signal indicative of the oxygen level in the engine exhaust.

The inventors herein have recognized that limiting the purge flow rate in response to an exhaust feedback signal does not solve the problem of hydrocarbon emissions described hereinabove. More specifically, the propagation time from the engine air/fuel intake to the engine exhaust delays the required correction to the purge flow rate. Accordingly, when a vapor purge is first initiated, the increase in hydrocarbon emissions caused by induction of fuel vapors cannot be corrected for a predetermined time. This perturbation in hydrocarbon emissions is dramatically increased in vehicles employing three-way catalytic converters (CO, HC, $NO_x$) which are designed to operate in a narrow range of air/fuel ratios referred to as stoichiometry. For example, a small decrease in air/fuel ratio from 14.7 to 14.6 may decrease the efficiency of the converter for removing hydrocarbons by approximately 20% (see SAE 82066, entitled "The Measurement and Improvement of the Transient A/F Characteristics of an Electronic Fuel Injection System", by D. R. Hamburg and D. Klick, 1982). This disadvantage is particularly troublesome when vapor purge is frequently cycled, such as while driving in urban areas.

SUMMARY OF THE INVENTION

It is an object of the present invention to reduce hydrocarbon emissions which are caused by purging the fuel vapors from a fuel vapor recovery system into the internal combustion engine.

The invention described herein provides both an apparatus and a method for controlling hydrocarbon emissions from an internal combustion engine having an air/fuel intake coupled to a fuel vapor recovery canister. In one embodiment in which the invention is used to advantage, the apparatus comprises means for inducting air and fuel into the air/fuel intake, means for periodically purging fuel vapors from the fuel vapor recovery canister into the air/fuel intake by inducting air through the fuel vapor recovery canister and into the air/fuel intake, an exhaust gas oxygen sensor coupled to the exhaust of the internal combustion engine, means for regulating the mixture of air and fuel vapor and fuel inducted into the air/fuel intake in response to the exhaust gas oxygen sensor to maintain a predetermined level of hydrocarbon emissions, means for indicating the concentration of fuel vapors in the fuel vapor recovery canister, and means responsive to the indicating means for controlling the flow rate of the purged fuel vapors during a predetermined time after the purging is initiated to achieve an inverse relation between the purged fuel vapor flow rate and the fuel vapor concentration when the fuel vapor concentration is above a predetermined concentration. Accordingly, the purge flow rate is controlled to be inversely related to the fuel vapor concentration during a predetermined time at the beginning of a vapor purge. Preferably, the predetermined time is approximately equal to the response time of the air/fuel regulation means. An advantage is thereby obtained of mitigating any increase in hydrocarbon emissions which might otherwise occur at the beginning of a purge cycle.

In an alternate embodiment in which the invention is used to advantage, the apparatus comprises a controller for providing engine spark timing, an exhaust gas oxygen sensor, means for regulating the air/fuel mixture inducted into the air/fuel intake in response to the exhaust gas oxygen sensor to maintain a predetermined level of hydrocarbon emissions, means for periodically purging fuel vapors from the fuel vapor recovery canister into the air/fuel intake, means for indicating the concentration of fuel vapors in the fuel vapor recovery canister, and timing means coupled to both the indicating means and the controller for retarding the engine spark timing by a timing offset related to the concentration of fuel vapors in the fuel vapor recovery canister whenever the step of purging is initiated, the timing means also gradually advancing the engine spark timing by the timing offset during a predetermined time after the step of retarding has been completed thereby advancing the engine spark timing back to its timing before the purging was initiated.

Thus, at the beginning of a purge cycle, the engine spark timing is retarded in relation to fuel vapor concentration. An advantage is thereby obtained of mitigating any increase in hydrocarbon emissions which may occur as a result of a purge while minimizing any loss in engine torque.

DESCRIPTION OF THE PREFERRED EMBODIMENT

Figure 1:
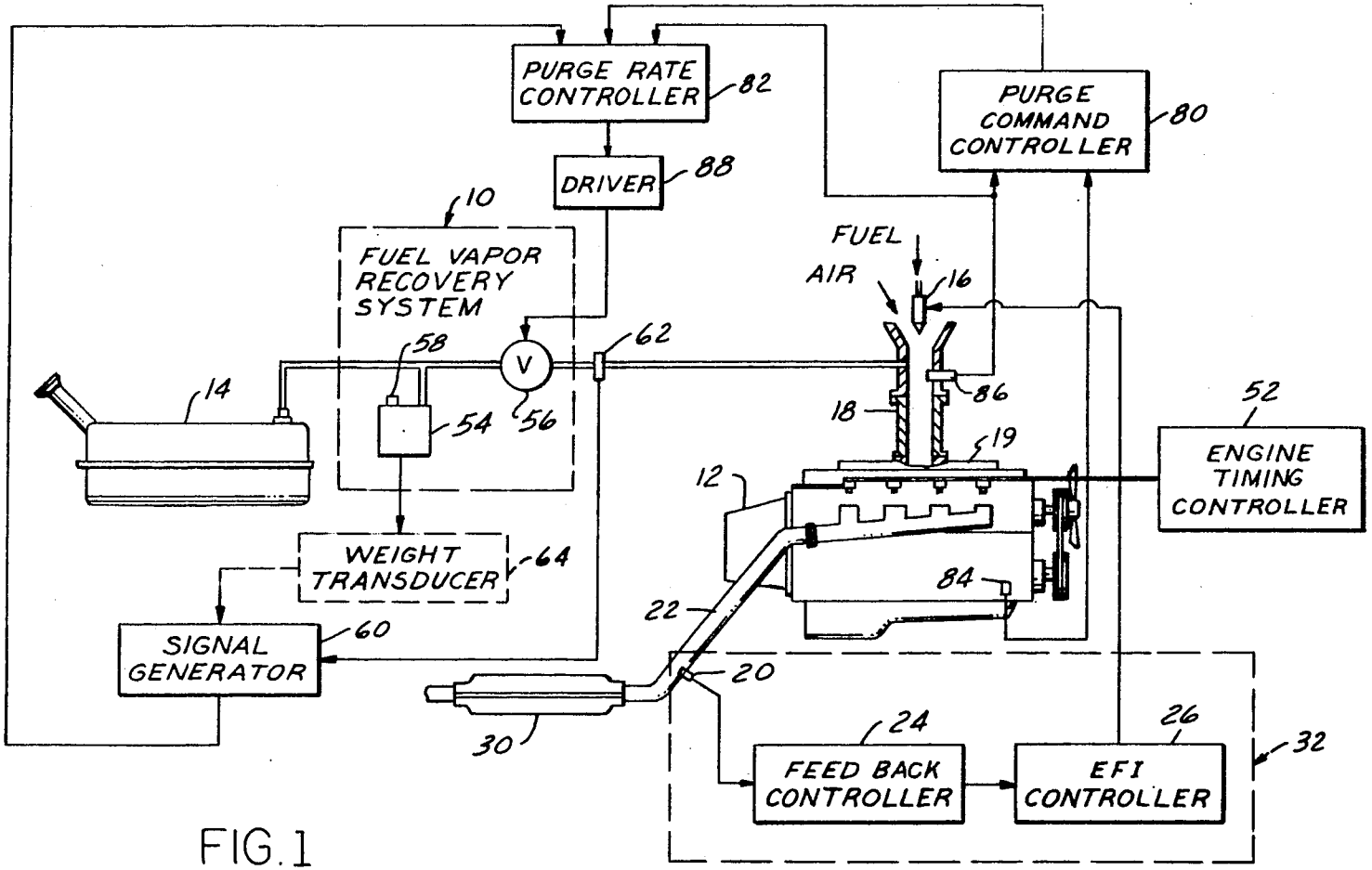
FIG. 1 shows a block diagram of an embodiment wherein the present invention may be used to advantage.

FIG. 1 shows fuel vapor recovery system 10 coupled between internal combustion engine 12 and fuel tank 14. Engine 12 is shown as an electronic fuel injected engine (EFI) wherein ambient air, fuel vapor from fuel system 10, and fuel from injector 16 are inducted into engine 12 through air/fuel inlet 18 and air/fuel intake manifold 19.

Although the illustrated embodiment shows a fuel injected engine having a single injector, the invention described herein may be used to advantage with multiport fuel injected engines and also carbureted engines. The invention may also be used to advantage when the fuel vapor recovery system is connected directly to the air/fuel intake manifold.

For the embodiment shown, the inducted mixture of fuel vapor, air and fuel, referred to hereinafter as air/fuel mixture, is regulated by feedback loop 32 coupled between engine exhaust 22 and fuel injector 16. Feedback loop 32 is shown including the series interconnection of exhaust gas oxygen sensor (EGO) 20, feedback controller 24, and EFI controller 26. In operation, EFI controller 26 regulates the fuel injected by injector 16 in response to EGO sensor 20 for maintaining an air/fuel ratio within the operating window of three-way catalytic converter 30.

Engine timing controller 52 is shown coupled to engine 12 in a conventional manner to provide engine spark timing dependent upon crankshaft position, referred to as nominal timing. Various algorithms may also be executed by engine timing controller 52 such as, for example, a timing algorithm for cold engine temperature operation.

Fuel vapor recovery system 10 is shown having a canister 54, preferably containing a vapor absorbing material such as activated charcoal, coupled between a vapor outlet vent of fuel tank 14 and vapor purge valve 56. Canister 54 is also shown having an ambient air valve 58 for enabling ambient air to be inducted therethrough when purge valve 56 is opened. During a fuel vapor purge of fuel vapor recovery system 10, a mixture of ambient air and fuel vapors from canister 54 will be inducted into air/fuel intake 19 of engine 12.

For reasons described hereinafter, a signal indicative of the fuel vapor concentration in fuel system 10 is generated by signal generator 60. Two alternate approaches are illustrated in FIG. 1 for generating the signal. In the first approach, hydrocarbon sensor 62 is shown coupled between the outlet side of purge valve 56 and signal generator 60. Hydrocarbon sensor 62 provides a voltage signal to signal generator 60 having an amplitude proportional to the detected level of hydrocarbons being purged. Signal generator 60 comprises a conventional A/D converter and scaling circuitry for converting the voltage signal to a digital signal which is related to the concentration of fuel vapors being purged from fuel vapor recovery system 10.

Figure 2:
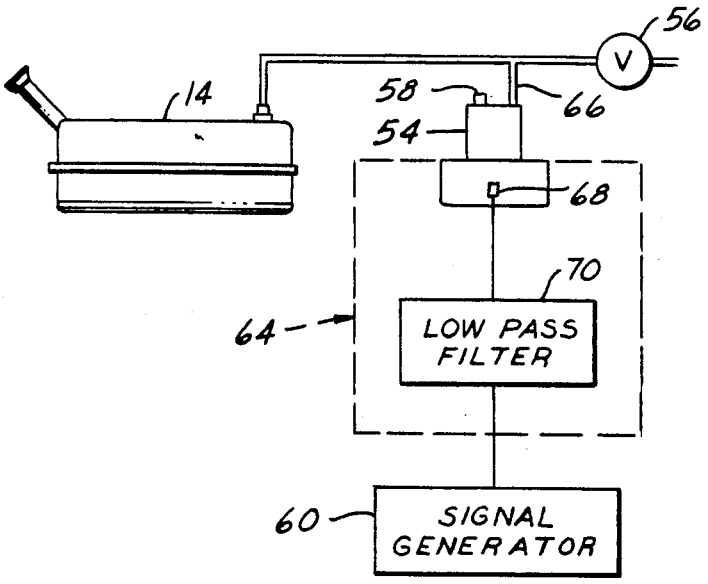
FIG. 2 illustrates a portion of the block diagram of FIG. 1 in greater detail.

In the second approach, shown by dashed lines in FIG. 1 and also shown in more detail in FIG. 2, signal generator 60 generates a signal indicative of fuel vapor concentration based upon the weight of canister 14. More specifically, canister 54 is shown coupled to fuel tank 14 by flexible line 66 (FIG. 2) and also coupled to weight transducer 64. Referring particularly to FIG. 2, weight transducer 64 comprises a conventional resistive strain gauge 68 mounted on deflectable load bearing member 66. Low pass filter 70, preferably having a band width of 0.05 Hz, is electrically connected to the output of strain gauge 66 for filtering out signal variations which are caused by factors other than canister weight such as, for example, vehicular suspension movement. The filtered output is then converted into an appropriate digital signal by signal generator 60. Since the weight of canister 54 is related to fuel vapor absorbtion, signal generator 60 provides a signal related to fuel vapor concentration in fuel vapor recovery system 10.

Referring back to FIG. 1, purge command controller 80 is shown having inputs coupled to engine temperature sensor 84 and mass airflow sensor (MAF) 86 positioned in air/fuel inlet 18. When engine 12 achieves both operating temperature and inducted airflow above threshold values, purge command controller 80 provides a purge command signal to purge rate controller 82 for actuating vapor purge valve 56 via solenoid or driver 88.

Purge rate controller 82, preferably including a look up table such as a ROM, is shown having inputs coupled to purge command controller 80 and signal generator 60 for reasons described hereinafter.

The operation of fuel vapor purging is now described with reference to FIG. 1. During a fuel vapor purge, purge rate controller 82 responds to MAF sensor 86 for controlling the purge flow rate to be proportional to the flow rate of air inducted into engine 12. More specifically, purge rate controller 82 provides a purge flow rate signal having a duty cycle equal to a proportionality constant (K) times the mass airflow. In response, driver 88 sequentially opens and closes purge valve 56 thereby controlling the purge flow rate to be proportional to the inducted airflow rate.

For a predetermined time at the beginning of a purge, preferably equal to the time response of feedback loop 32, purge rate controller 82 also controls the purge flow rate in an inverse relation to the purged fuel vapor concentration. More specifically, purge rate controller 82 reduces the proportionality constant (K) in proportion to the indication of fuel vapor concentration provided by signal generator 60. Accordingly, the purge flow rate is reduced in relation to fuel vapor concentration until feedback loop 32 is able to correct for the perturbation in the air/fuel mixture caused by the purge. Thus, the sharp increase in hydrocarbon emissions which would otherwise occur during the time required for feedback loop 32 to respond are eliminated.

Purge rate controller 82 controls the purge rate in an inverse relation to purged fuel vapor concentration only when the fuel vapor concentration is above a desired or predetermined value. There may be occurrences, such as during either a prolonged purge or frequent purges, wherein the fuel vapor concentration is less than the desired air/fuel ratio. Accordingly, when the fuel vapor concentration is less than the desired concentration, purge rate controller 82 does not restrict the purge rate. Those skilled in the art will also recognize that when the fuel vapor concentration is below the desired concentration, the purge rate may be controlled to be directly proportional to vapor concentration.

Figure 3:
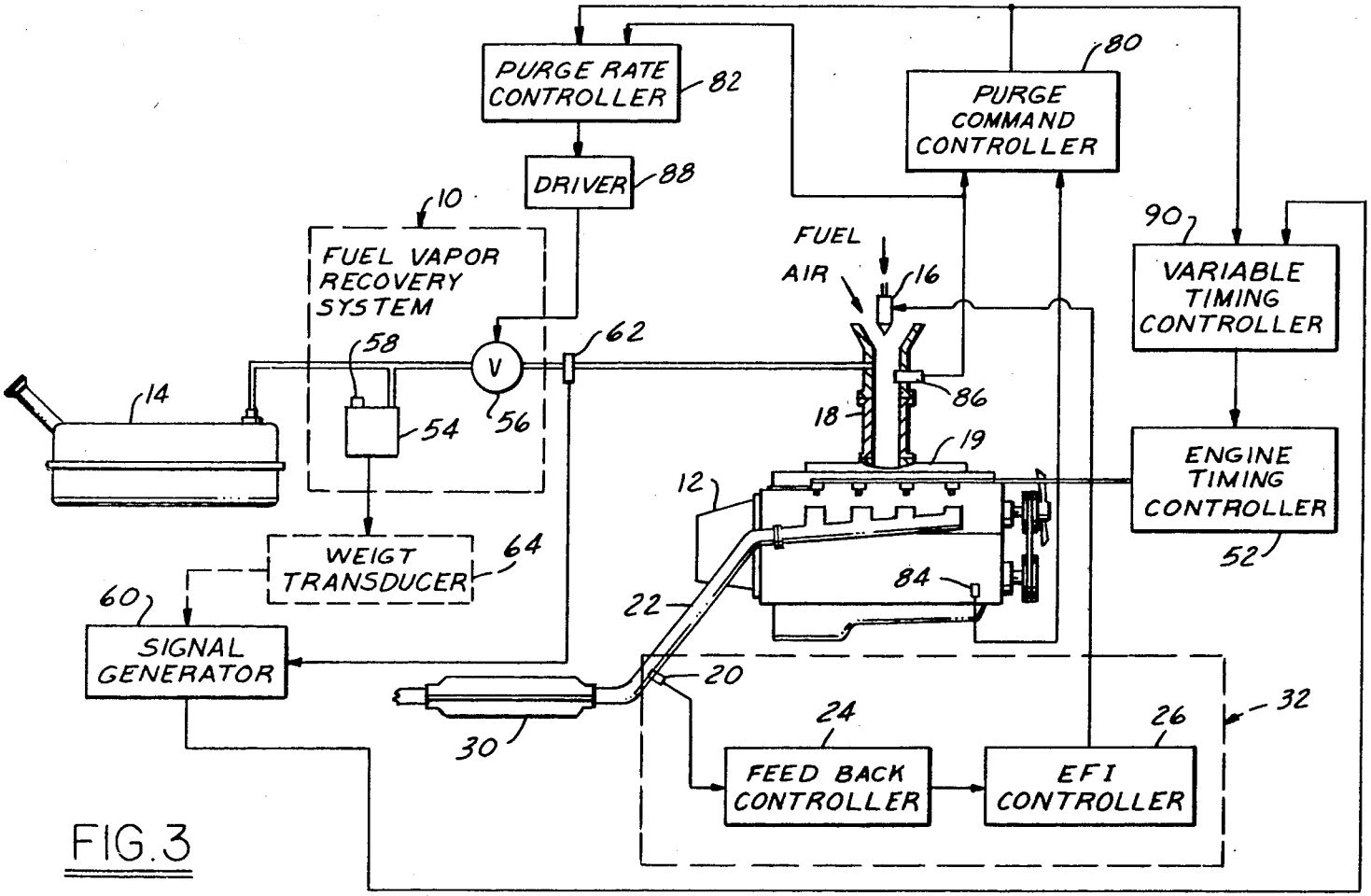
FIG. 3 shows a block diagram of an alternate embodiment wherein the present invention may be used to advantage.

An alternate embodiment is shown in FIG. 3 wherein engine spark timing is retarded as a function of the concentration of fuel vapors in fuel vapor recovery system 10. Variable timing controller 90 having inputs from both signal generator 60 and purge command controller 80 is shown coupled to engine timing controller 52. In response to a purge command, variable timing controller 90 retards the engine spark timing by a timing offset at the beginning of a vapor purge. Longer burn time is thereby provided in the engine cylinders to reduce any increase in hydrocarbon emissions which may otherwise occur at the beginning of a purge.

Variable timing controller 90 also varies the timing offset in relation to the indication of fuel vapor concentration provided by signal generator 60. By retarding the engine spark timing only by the amount required to burn the purged vapors, any decrease in engine torque which results from the timing offset is minimized.

During a predetermined time after the initiation of a purge, preferably equal to the time response of feedback loop 32, variable timing controller 90 also gradually advances the engine spark timing at a predetermined rate back to the nominal engine timing.

This concludes the description of the preferred embodiment. The reading of it by those skilled in the art will bring to mind many alterations and modifications without departing from the spirit and scope of the invention. Accordingly, it is intended that the scope of the invention be limited by only the following claims.

We claim:

1. A method for controlling hydrocarbon emissions from an internal combustion engine having an air/fuel intake coupled to a fuel vapor recovery system, comprising the steps of:

inducting air and fuel into said air/fuel intake;

periodically purging fuel vapors from said fuel vapor recovery system into said air/fuel intake by inducting air through said fuel vapor recovery system and into said air/fuel intake;

regulating the mixture of air, fuel vapor and fuel inducted into said air/fuel intake in response to an exhaust gas oxygen sensor to maintain a predetermined level of hydrocarbon emissions;

generating a signal related to the concentration of fuel vapors in said fuel vapor recovery system; and controlling the flow rate of the purged fuel vapors in response to said signal to achieve an inverse relation between the purged flow rate and the fuel vapor concentration when the fuel vapor concentration is above a predetermined concentration so that said regulating step is able to maintain said predetermined level of hydrocarbon emissions during said purging step.

2. An apparatus for controlling hydrocarbon emissions from an internal combustion engine having an air/fuel intake coupled to a fuel vapor recovery canister, comprising:

means for inducting air and fuel into said air/fuel intake;

means for periodically purging fuel vapors from said fuel vapor recovery canister into said air/fuel intake by inducting air through said fuel vapor recovery canister and into said air/fuel intake;

an exhaust gas oxygen sensor coupled to the exhaust of said internal combustion engine;

means for regulating the mixture of air, fuel vapor and fuel inducted into said air/fuel intake in response to said exhaust gas oxygen sensor to maintain a predetermined level of hydrocarbon emissions;

means for indicating the concentration of fuel vapors in said fuel vapor recovery canister; and means responsive to said indicating means for controlling the flow rate of the purged fuel vapors during a predetermined time after said purging is initiated to achieve an inverse relation between the purged fuel vapor flow rate and the fuel vapor concentration when the fuel vapor concentration is above a predetermined concentration so that said regulating means is able to maintain said predetermined level of hydrocarbon emissions during said purging of said fuel vapors.

3. The apparatus recited in claim 2 wherein said predetermined time is substantially equal to the time required for a volume of air and fuel to propagate from said air/fuel inlet through said internal combustion engine to said exhaust gas oxygen sensor.

4. An apparatus for controlling hydrocarbon emissions from an internal combustion engine having an air/fuel intake coupled to a fuel vapor recovery canister, comprising:

means for inducting air and fuel into said air/fuel intake;

means for periodically purging fuel vapors from said fuel vapor recovery canister into said air/intake by inducting air through said fuel vapor recovery canister and into said air/fuel intake;

an exhaust gas oxygen sensor coupled to the exhaust of said internal combustion engine;

means for regulating the mixture of air, fuel vapor and fuel inducted into said air/fuel intake in response to said exhaust gas oxygen sensor to maintain a predetermined level of hydrocarbon emissions;

means for indicating the concentration of fuel vapors in said fuel vapor recovery canister, said indicating means comprises means for weighing said canister; and means responsive to said indicating means for controlling the flow rate of the purged fuel vapors during a predetermined time after said purging is initiated to achieve an inverse relation between the purged fuel vapor flow rate and the fuel vapor concentration when the fuel vapor concentration is above a predetermined concentration so that said regulating means is able to maintain said predetermined level of hydrocarbon emissions during said purging of said fuel vapors.

5. The apparatus recited in claim 2 wherein said indicating means comprises a fuel vapor sensor coupled to said fuel vapor recovery canister.

6. A method for controlling hydrocarbon emissions from an internal combustion engine having an air/fuel intake coupled to a fuel vapor recovery system, comprising the steps of:

providing engine spark timing to said internal combustion engine;

periodically purging fuel vapors from said fuel vapor recovery system into said air/fuel intake;

generating a signal related to the concentration of fuel vapors in said fuel vapor recovery system;

retarding said engine spark timing by a timing offset related to the concentration of fuel vapors in said fuel vapor recovery system whenever said step of purging is initiated; and advancing said engine spark timing back to its timing before said step of purging was initiated.

7. An apparatus for controlling hydrocarbon emissions from an internal combustion engine having an air/fuel intake coupled to a fuel vapor recovery canister, comprising:

means for inducting air and fuel into said air/fuel mixture;

means for periodically purging fuel vapors from said fuel vapor recovery canister into said air/fuel intake;

an exhaust gas oxygen sensor coupled to the exhaust of said internal combustion engine;

means responsive to said exhaust gas oxygen sensor for regulating the air/fuel mixture inducted into said air/fuel intake to maintain a predetermined level of hydrocarbon emissions;

means for indicating the concentration of fuel vapors in said fuel vapor recovery canister;

a controller for providing engine spark timing to said internal combustion engine; and timing means responsive to said indicating means and coupled to said controller for retarding said engine spark timing by a timing offset related to the concentration of fuel vapors in said fuel vapor recovery canister whenever said purging is initiated so that said regulating means is able to maintain said predetermined level of hydrocarbon emissions during said purging of said fuel vapors, said timing means also gradually advancing said engine spark timing by said timing offset during a predetermined time after said step of retarding has been completed thereby advancing said engine spark timing back to its timing before said purging was initiated.

8. The apparatus recited in claim 7 wherein said indicating means comprises means of weighing said canister.

9. The apparatus recited in claim 7 wherein said indicating means comprises a fuel vapor sensor coupled to said fuel vapor recovery canister.

10. The apparatus recited in claim 7 wherein said predetermined time is approximately equal to the propogation delay of a charge of air and fuel through said engine to said exhaust gas oxygen sensor.

11. The apparatus recited in claim 7 wherein said purging means is responsive to the flow rate of air inducted into said air/fuel intake.

12. The apparatus recited in claim 7 wherein said purging means is responsive to the temperature of said internal combustion engine.

* * * * *